US010262593B2

(12) United States Patent
Chen et al.

(10) Patent No.: US 10,262,593 B2
(45) Date of Patent: Apr. 16, 2019

(54) LIGHT EMITTING DRIVE CIRCUIT AND ORGANIC LIGHT EMITTING DISPLAY

(71) Applicant: Shenzhen China Star Optoelectronics Technology Co., Ltd., Shenzhen, Guangdong (CN)

(72) Inventors: Xiaolong Chen, Guangdong (CN); Ming-jong Jou, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 101 days.

(21) Appl. No.: 15/504,436

(22) PCT Filed: Jan. 18, 2017

(86) PCT No.: PCT/CN2017/071509
§ 371 (c)(1),
(2) Date: Feb. 16, 2017

(87) PCT Pub. No.: WO2018/120338
PCT Pub. Date: Jul. 5, 2018

(65) Prior Publication Data

US 2018/0226026 A1 Aug. 9, 2018

(30) Foreign Application Priority Data

Dec. 26, 2016 (CN) ..... 2016 1 1220796

(51) Int. Cl.
*G09G 3/3258* (2016.01)
*G09G 3/3233* (2016.01)
*G09G 3/3208* (2016.01)

(52) U.S. Cl.
CPC ..... *G09G 3/3258* (2013.01); *G09G 3/3208* (2013.01); *G09G 3/3233* (2013.01);
(Continued)

(58) Field of Classification Search
CPC ..... G09G 3/3258; G09G 2320/045; G09G 2300/0842; G09G 3/3233
See application file for complete search history.

(56) References Cited

U.S. PATENT DOCUMENTS 8,982,017 B2 3/2015 Lee
2013/0057532 A1 3/2013 Lee
(Continued)

FOREIGN PATENT DOCUMENTS

CN 103000134 A 3/2013
CN 104282263 A 1/2015
(Continued)

*Primary Examiner* — Ibrahim A Khan
(74) *Attorney, Agent, or Firm* — Andrew C. Cheng

(57) ABSTRACT

The present disclosure provides a light emitting drive circuit and an organic light emitting display. The circuit includes: the reset memory module for resetting the driving module and for generating and storing a threshold offset voltage corresponding to the driving module; the driving module is used for generating a light emission drive voltage in a light emission phase in accordance with a power supply positive voltage, a stored threshold compensation voltage, and a light emission control signal; the light emitting module is configured to emit light, and the light emission driving voltage is a difference between the power supply positive voltage and the data voltage. The driving voltage (or drive current) of the light emission is independent of the threshold voltage for driving the thin film transistor. This eliminates the problem that the threshold voltage drift of the driving thin film transistor causes the screen display to be poor.

12 Claims, 4 Drawing Sheets

(52) U.S. Cl.
CPC ..... *G09G 2300/0842* (2013.01); *G09G 2320/045* (2013.01)

(56) References Cited

U.S. PATENT DOCUMENTS

| | | | | |
|---|---|---|---|---|
| 2013/0335307 | A1* | 12/2013 | Guo | G09G 3/3258 345/76 |
| 2016/0103513 | A1* | 4/2016 | Yang | G06F 3/041 345/175 |
| 2016/0140900 | A1* | 5/2016 | Yang | G09G 3/3258 345/206 |
| 2017/0018226 | A1* | 1/2017 | Yang | G09G 3/3233 |
| 2017/0039945 | A1* | 2/2017 | Wang | G09G 3/3258 |
| 2017/0103701 | A1* | 4/2017 | Zhu | G09G 3/3233 |
| 2018/0114487 | A1* | 4/2018 | He | G09G 3/3258 |

FOREIGN PATENT DOCUMENTS

| | | | |
|---|---|---|---|
| CN | 104978932 | A | 10/2015 |
| CN | 105096831 | A | 11/2015 |
| CN | 105845081 | A | 8/2016 |

* cited by examiner

LIGHT EMITTING DRIVE CIRCUIT AND ORGANIC LIGHT EMITTING DISPLAY

FIELD OF THE DISCLOSURE

The present disclosure relates to a display technology field, and more particularly to a light emitting drive circuit and an organic light emitting display.

BACKGROUND OF THE DISCLOSURE

In recent years, organic light-emitting diodes (OLED) displays have become very popular at home and abroad emerging flat panel display products, this is because the OLED display with self-luminous, wide viewing angle (up to 175°), short response time (1 μs), high luminous efficiency, wide gamut, thin thickness (less than 1 mm), can be made large size and flexible display and process characteristics such as simple, but it also has the potential of low cost.

The existing OLED display can be divided into passive (PMOLED) and active (AMOLED) according to the driving mode. In AMOLED, usually thin-film transistor (TFT) with the capacitor to store the signal to control the brightness of OLED grayscale performance. In order to achieve the purpose of constant current drive, each pixel requires at least two TFT and a storage capacitor to form, that 2T1C mode. FIG. 1 is a circuit diagram of a basic driving circuit of a conventional AMOLED. Refer to FIG. 1, the basic AMOLED driving circuit of the prior art includes two thin film transistors (TFTs) and a capacitor, in particular, a switching TFT T1, a driving TFT T2 and a storage capacitor Cst. The driving current of the OLED is controlled by the driving TFT T2 whose current magnitude is: $I_{OLED}=k(V_{gs}-V_{th})^2$ where k is the intrinsic conduction factor of the driving TFT T2, which is determined by the driving TFT T2 itself and Vth is the threshold voltage of the driving TFT T2. The threshold voltage Vth of the driving TFT T2 is drifted due to the long-time operation, resulting in a change in the OLED driving current, causing a defect in the OLED display and affecting the image quality.

SUMMARY OF THE DISCLOSURE

In order to solve the above-described problems of the prior art, it is an object of the present disclosure to provide a light-emitting drive circuit and an organic light-emitting display device capable of eliminating the influence of a threshold voltage driving a thin film transistor.

According to an aspect of the present disclosure, there is provided a light emitting drive circuit including: a reset memory module, a driving module, and a light emitting module; the reset memory module is used for resetting the driving module according to a first control signal and a second control signal in a potential resetting stage, and for generating and storing a threshold offset voltage corresponding to the driving module in accordance with the first control signal and a data voltage in a threshold offset voltage storage stage; the driving module is used for generating a light emission drive voltage in a light emission phase in accordance with a power supply positive voltage, a stored threshold compensation voltage, and a light emission control signal; the light emitting module is configured to emit light in accordance with the light emission drive voltage, the light emission control signal, and a power supply negative voltage in the light emission phase, and the light emission driving voltage is a difference between the power supply positive voltage and the data voltage.

Optionally, the reset memory module includes a first control terminal, a second control terminal and a reset voltage terminal, the first control terminal and the second control terminal are respectively used for receiving a first control signal and a second control signal, and the reset voltage terminal is used for receiving a reset voltage or a data voltage; the driving module includes a first drive control terminal, a second drive control terminal, a power supply positive terminal and a first connecting terminal, the first drive control terminal is connected with the reset memory module, the second drive control terminal is adapted to receive the light emission control signal, the power supply positive terminal is used for receiving the power supply positive voltage, the first connection terminal is respectively connected with the reset memory module and the light emitting module; the light emitting module includes: a light emitting control terminal, a power supply negative connecting terminal and a second connecting terminal, the light emitting control terminal is used for receiving the light emission control signal, the power supply negative connecting terminal is used for receiving the power supply negative voltage, the second connecting terminal is respectively connected with the reset memory module and the driving module.

Optionally, the first control terminal and the second control terminal respectively receive the first control signal and the second control signal during the potential resetting phase, the reset voltage terminal receives the reset voltage, and the reset memory module transfers the reset voltage to the driving module according to the first control signal and the second control signal; in the threshold compensation voltage storage stage, the first control terminal receives a first control signal, the reset voltage terminal receives a data voltage, and the reset memory module generates and stores a threshold compensation voltage corresponding to the driving module according to the first control signal and the data voltage.

Optionally, in the light emitting phase, the first drive control terminal receives the stored threshold compensation voltage, the second drive control terminal receives the light emission control signal, the power supply positive terminal receives the power supply positive voltage, the driving module generates a light emission driving voltage based on the power supply positive voltage, the stored threshold compensation voltage, and the light emission control signal.

Optionally, in the light emitting phase, the light emission control terminal receives the light emission control signal, the power supply negative terminal receives the power supply negative voltage, and the second connection terminal receives the light emission driving voltage.

Optionally, the reset memory module includes: a second thin film transistor, a third thin film transistor, a fourth thin film transistor and a capacitor, the gate of the second thin film transistor and the third thin film transistor serves as the first control terminal for receiving the first control signal; the gate of the fourth thin film transistor serves as the second control terminal for receiving the second control signal; the source of the second thin film transistor serves as the reset voltage terminal for receiving the reset voltage and the data voltage; the drains of the second thin film transistor are respectively connected to the source of the fourth thin film transistor and the driving module; the drains of the third thin film transistor are respectively connected to the driving module and the light emitting module, the sources of the third thin film transistor are respectively connected to the drains of the fourth thin film transistor and the driving module; one end of the capacitor is connected to the source of the third thin film transistor, the other end of the capacitor is electrically grounded.

Optionally, the driving module includes: a first thin film transistor and a fifth thin film transistor; the gate of the first thin film transistor serves as the first driving control terminal for connecting the source of the third thin film transistor; the sources of the first thin film transistor are respectively connected to the drain of the second thin film transistor and the fifth transistor; the drain of the first thin film transistor serves as the first connecting terminal for connecting to the drain of the third transistor and the light emitting module; the gate of the fifth transistor serves as the second drive control terminal for receiving the light emitting control signal; the source of the fifth transistor serves as the power supply positive connecting terminal for receiving the power supply positive voltage.

Optionally, the light emitting module includes: a sixth thin film transistor and an organic light emitting diodes; the gate of the sixth thin film transistor serves as the light emitting control terminal for receiving the light emitting control signal; the source of the sixth thin film transistor serves as the second connecting terminal for connecting to the drain of the first thin film transistor; the drain of the sixth thin film transistor connects to the anode of the organic light emitting diodes; the cathode of the organic light emitting diodes serves as the power supply negative connecting terminal for receiving the power supply negative voltage.

Optionally, the first thin film transistor to the sixth thin film transistor are both P-type thin film transistors, the first control signal, the second control signal and the light emitting control signal are low level signals.

According to another aspect of the present disclosure, there is also provided an organic light emitting display having the above described light emitting drive circuit.

The advantageous effects of the present disclosure: the driving current (or light emitting driving voltage) of the organic light emitting diode is independent of the threshold voltage driving the thin film transistor, so that the problem of poor display of the organic light emitting display screen due to the threshold voltage drift of the driving thin film transistor can be eliminated.

BRIEF DESCRIPTION OF THE DRAWINGS

The above and other aspects, features and advantages of the embodiments of the present disclosure will become more apparent from the following description taken in conjunction with the accompanying drawings in which.

DETAILED DESCRIPTION OF PREFERRED EMBODIMENTS

Figure 1:
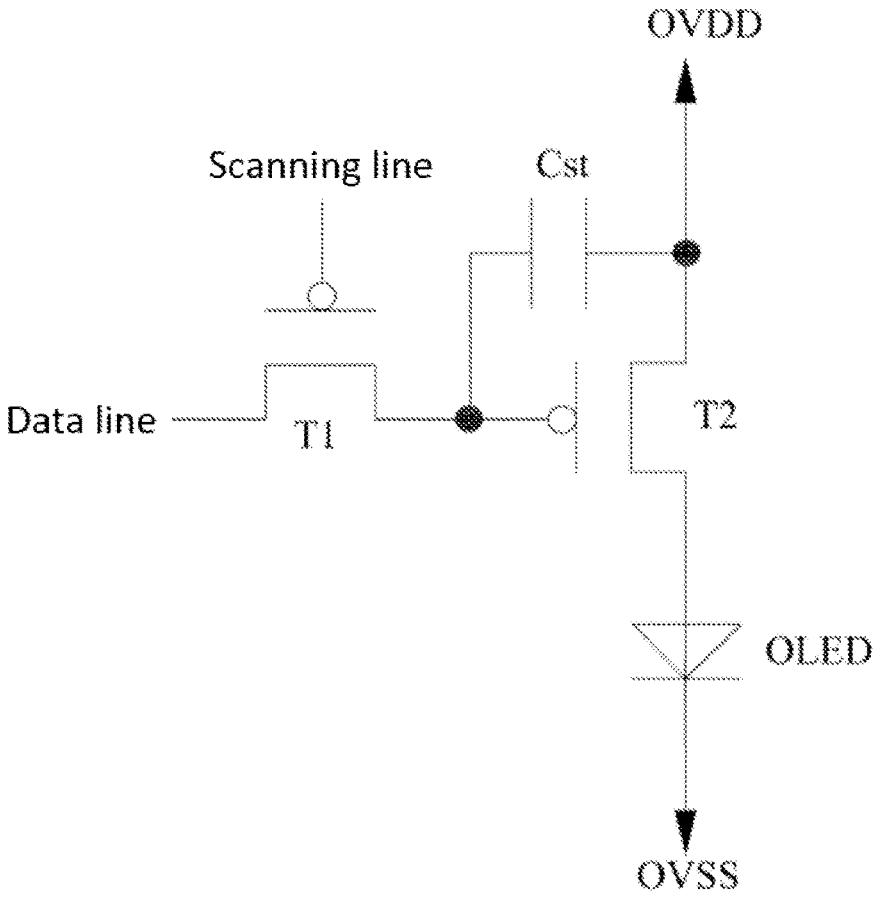
FIG. 1 is a circuit diagram of the basic driving circuit of the conventional AMOLED.

Hereinafter, embodiments of the present disclosure will be described in detail with reference to the accompanying drawings. However, in many different forms and embodiments of the present disclosure, and the disclosure should not be construed as limited to the specific embodiments set forth herein. Rather, these embodiments are provided to explain the principles of the disclosure and its practical application so that others skilled in the art to understand the disclosure for various embodiments and various modifications suited to the particular intended application.

In the drawings, for clarity, exaggerated thickness of layers and regions. The same reference numerals throughout the specification and the drawings can be used to denote the same elements.

Figure 2:
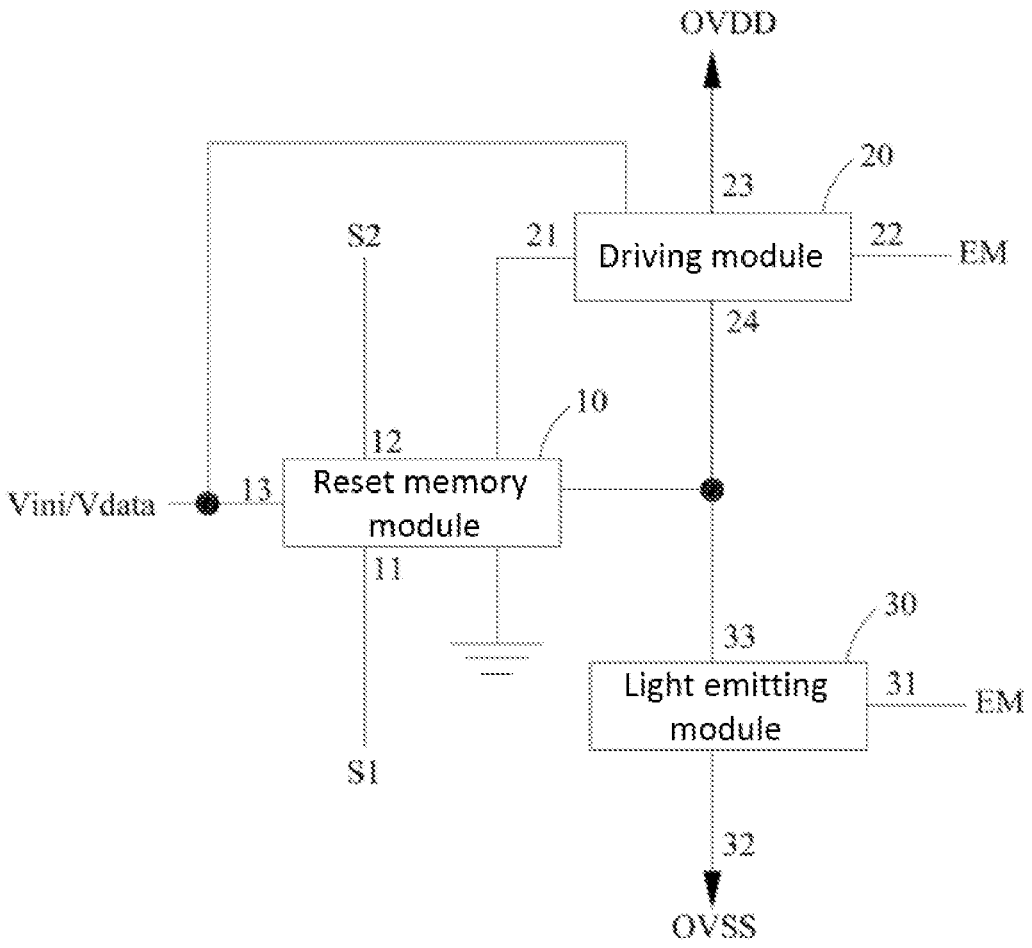
FIG. 2 is a block diagram of the light emitting driving circuit of the embodiment of the present disclosure.

FIG. 2 is a block diagram of the light emitting driving circuit of the embodiment of the present disclosure.

Refer to FIG. 2, the light emitting drive circuit of the embodiment of the present disclosure includes: a reset memory module 10, a driving module 20 and a light emitting module 30.

The reset memory module 10 is used for resetting the driving module 20 according to a first control signal S1 and a second control signal S2 in a potential resetting stage, and for generating and storing a threshold offset voltage Vdata−Vth corresponding to the driving module 20 in accordance with the first control signal S1 and a data voltage Vdata in a threshold offset voltage storage stage. In the present embodiment, the first control signal S1 and the second control signal S2 are low level signal.

Specifically, the reset memory module 10 includes a first control terminal 11, a second control terminal 12 and a reset voltage terminal 13, the first control terminal 11 and the second control terminal 12 are respectively used for receiving a first control signal S1 and a second control signal S2, and the reset voltage terminal 13 is used for receiving a reset voltage Vini or a data voltage Vdata. In the present embodiment, the reset voltage Vini is low voltage.

The first control terminal 11 and the second control terminal 12 respectively receive the first control signal S1 and the second control signal S2 during the potential resetting phase, the reset voltage terminal 13 receives the reset voltage Vini, and the reset memory module 10 transfers the reset voltage Vini to the driving module 20 according to the first control signal S1 and the second control signal S2.

In the threshold compensation voltage storage stage, the first control terminal 11 receives a first control signal S1, the reset voltage terminal 13 receives a data voltage Vdata, and the reset memory module 10 generates and stores a threshold compensation voltage Vdata−Vth corresponding to the driving module 20 according to the first control signal S1 and the data voltage Vdata.

The driving module 20 is used for generating a light emission drive voltage OVDD−Vdata in a light emission phase in accordance with a power supply positive voltage OVDD, a stored threshold compensation voltage Vdata−Vth, and a light emission control signal EM. In the present embodiment, the light emitting control signal EM is low level signal.

The driving module 20 includes a first drive control terminal 21, a second drive control terminal 22, a power supply positive terminal 23 and a first connecting terminal 24; the first drive control terminal 21 is connected with the reset memory module 10, the second drive control terminal 22 is adapted to receive the light emission control signal EM, the power supply positive terminal 23 is used for receiving the power supply positive voltage OVDD, the first connection terminal 24 is respectively connected with the reset memory module 10 and the light emitting module 30.

In the lighting phase, the second drive control terminal 22 receives the light emission control signal EM, and the power supply positive terminal 23 receives the power supply positive voltage OVDD, and the threshold compensation voltage OVDD−Vdata stored in the capacitor C is applied to the first drive control terminal 21.

The light emitting module 30 is configured to emit light in the light emission phase in accordance with the light emission drive voltage OVDD−Vdata, the light emission control signal EM, and the voltage negative voltage OVSS, wherein the light emission drive voltage OVDD−Vdata is the difference between the power supply positive voltage OVDD and the data voltage Vdata.

Specifically, the light emitting module 30 includes: a light emitting control terminal 31, a power supply negative connecting terminal 32 and a second connecting terminal 33, the light emitting control terminal 31 is used for receiving the light emission control signal, the power supply negative connecting terminal 32 is used for receiving the power supply negative voltage OVSS, the second connecting terminal 33 is respectively connected with the reset memory module 10 and the driving module 30.

In the light emitting phase, the light emission control terminal 31 receives the light emission control signal EM, the power supply negative terminal 32 receives the power supply negative voltage OVSS, and the second connection terminal 33 receives the light emission driving voltage OVDD−Vdata.

Figure 3:
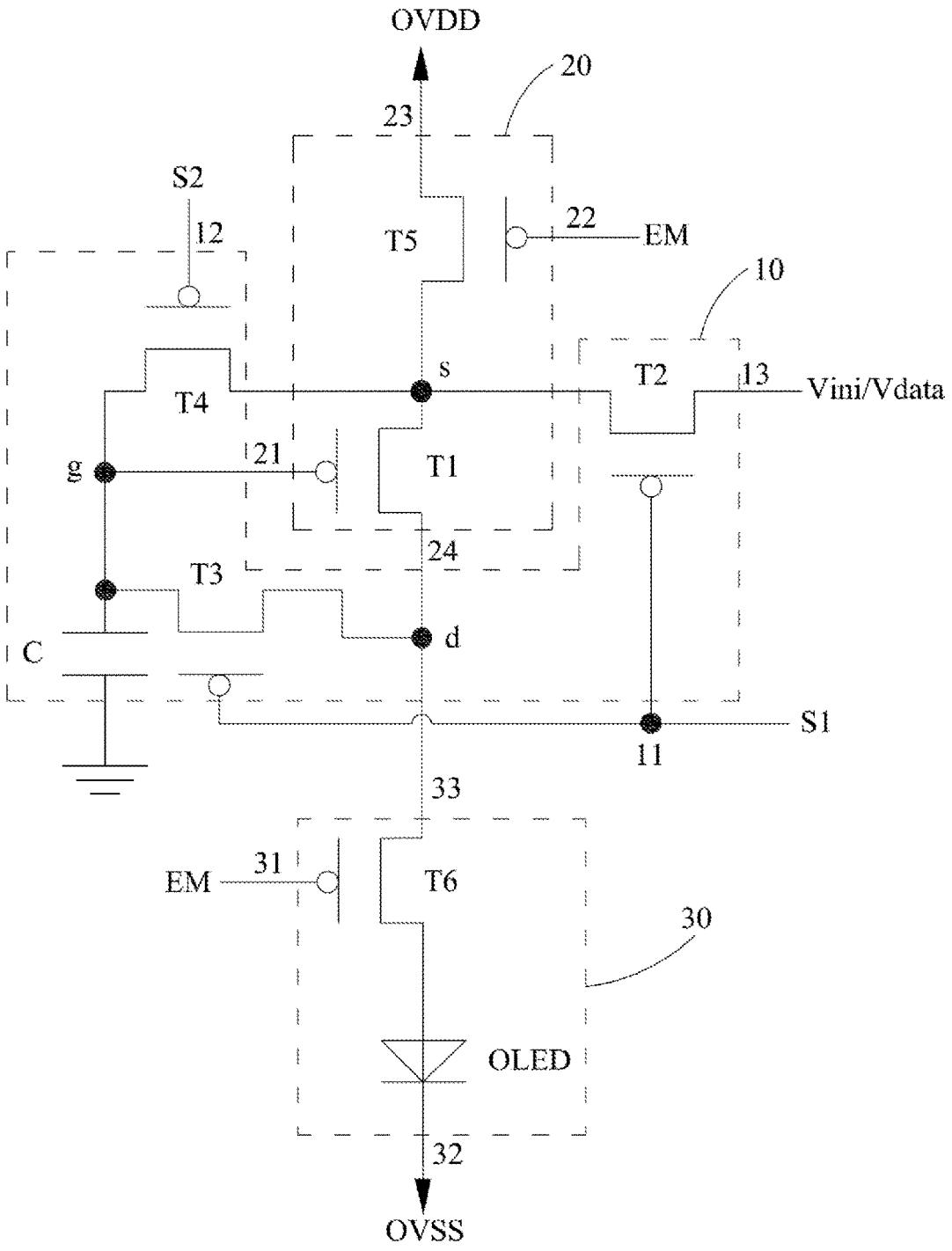
FIG. 3 is a schematic diagram of the specific circuit configuration of the light emitting drive circuit according to the embodiment of the present disclosure.

FIG. 3 is a schematic diagram of the specific circuit configuration of the light emitting drive circuit according to the embodiment of the present disclosure.

Refer to FIG. 3, the light emitting drive circuit of the embodiment of the present disclosure includes 6 thin film transistor and a capacitor, wherein, the first thin film transistor T1 is a driving thin film transistor, and the second thin film transistor T2 to the sixth thin film transistor T6 are switching thin film transistors.

The reset memory module 10 includes: a second thin film transistor T2, a third thin film transistor T3, a fourth thin film transistor T4 and a capacitor C, the gate of the second thin film transistor T2 and the third thin film transistor T3 serves as the first control terminal 11 for receiving the first control signal S1. The gate of the fourth thin film transistor T4 serves as the second control terminal 12 for receiving the second control signal S2. The source of the second thin film transistor T2 serves as the reset voltage terminal 13 for receiving the reset voltage Vini and the data voltage Vdata. The drains of the second thin film transistor T2 are respectively connected to the source of the fourth thin film transistor T4 and the driving module 20. The drains of the third thin film transistor T3 are respectively connected to the driving module 20 and the light emitting module 30, the sources of the third thin film transistor T3 are respectively connected to the drains of the fourth thin film transistor T4 and the driving module 20. One end of the capacitor C is connected to the source of the third thin film transistor T3, the other end of the capacitor C is electrically grounded.

The driving module 20 includes: a first thin film transistor T1 and a fifth thin film transistor T5. The gate of the first thin film transistor T1 serves as the first driving control terminal 21 for connecting the source of the third thin film transistor T3. The sources of the first thin film transistor T1 are respectively connected to the drain of the second thin film transistor T2 and the fifth transistor T5. The drain of the first thin film transistor T1 serves as the first connecting terminal 24 for connecting to the drain of the third transistor T3 and the light emitting module 30. The gate of the fifth transistor T5 serves as the second drive control terminal 22 for receiving the light emitting control signal EM. The source of the fifth transistor T5 serves as the power supply positive connecting terminal 23 for receiving the power supply positive voltage OVDD.

The light emitting module 30 includes: a sixth thin film transistor T6 and an organic light emitting diodes OLED. The gate of the sixth thin film transistor T6 serves as the light emitting control terminal 31 for receiving the light emitting control signal EM. The source of the sixth thin film transistor T6 serves as the second connecting terminal 33 for connecting to the drain of the first thin film transistor T1 and the third thin film transistor T3. The drain of the sixth thin film transistor T6 connects to the anode of the organic light emitting diodes OLED; the cathode of the organic light emitting diodes OLED serves as the power supply negative connecting terminal 32 for receiving the power supply negative voltage OVSS.

Preferably, the first thin film transistor T1, the second thin film transistor T2, the third thin film transistor T3, the fourth thin film transistor T4, the fifth thin film transistor T5 and the sixth thin film transistor T6 in the embodiment of the present disclosure are P-type thin film transistor. Accordingly, the corresponding thin film transistor is turned on when the control signal is set to a low level. Of course, in the actual circuit design, the thin film transistor used in the embodiment of the present disclosure can also adopt the N-type thin film transistor or the N-type thin film transistor and the P-type thin film transistor hybrid mode, and the source and the drain of the thin film transistor used are interchangeable depending on the type of the thin film transistor and the signal of the signal segment, and are not specifically distinguished here.

Figure 4:
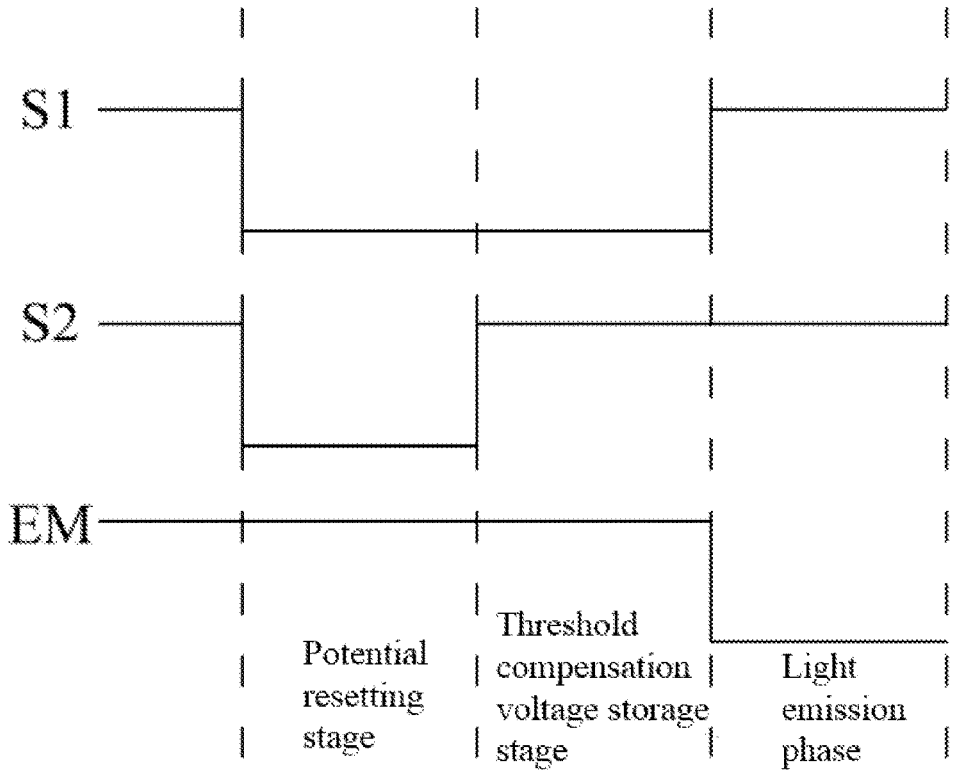
FIG. 4 is a timing chart of the control signal of the light emitting drive circuit shown in FIG. 3.

FIG. 4 is a timing chart of the control signal of the light emitting drive circuit shown in FIG. 3. The operation principle of the light-emission drive circuit according to the embodiment of the present disclosure will be described below with reference to the light-emission drive circuit shown in FIG. 3 and the control signal timing diagram shown in FIG. 4. The light-emitting drive circuit can be divided into three stages: a potential reset phase for driving the gate of the thin film transistor, a threshold compensation voltage storage phase, and a light emission phase. The specific analysis is as follows:

The first stage is a potential resetting stage for driving the gate of the thin film transistor. In the first stage, the first control signal S1 and the second control signal S2 are set to a low level, and the light emitting control signal EM is set to a high level. At this time, the second thin film transistor T2, the third thin film transistor T3, and the fourth thin film transistor T4 are turned on, and the fifth thin film transistor T5 and the sixth thin film transistor T6 are turned off. At this time, the reset voltage Vini received from the source of the second thin film transistor T2 is output to the point s through the drain of the second thin film transistor T2, and the potential Vs=Vini at the point s; the reset voltage Vini is output to the point g through the fourth thin film transistor T4 and the potential at the point g is Vg=Vini to charge the capacitor C; the reset voltage Vini is output to the d point via the third thin film transistor T3, and the potential at the point d is Vd=Vini; the organic light emitting diode OLED does not emit light. The gate of the first thin film transistor T1 is connected to the point g, so that the gate of the first thin film transistor T1 is reset to a low level. This stage completes the resetting of the gate of the driving thin film transistor.

The second stage is the threshold offset voltage storage phase. In the second stage, the first control signal S1 is set to the low level, and the second control signal S2 and the light-emission control signal EM are set to the high level. At this time, the second thin film transistor T2 and the third thin film transistor T3 are turned on, and the fourth thin film transistor T4, the fifth thin film transistor T5, and the sixth thin film transistor T6 are turned off. At this time, the data voltage Vdata received from the source of the second thin film transistor T2 is output to the point s through the drain of the second thin film transistor T2, and the potential at the point s becomes Vs=Vdata. The data voltage Vdata charges the capacitor C through the third thin film transistor T3 and the first thin film transistor T1 until the voltage difference Vs−Vg=Vth between the point s and the point g, where Vth is the threshold voltage of the first thin film transistor T1. At this time Vg=Vs−Vth=Vdata−Vth, and the threshold offset voltage Vdata−Vth is stored in the capacitor C. This stage completes the storage of the threshold offset voltage.

The third stage is the luminous stage. In the third stage, the light-emission control signal EM is set to a low level, and the first control signal S1 and the second control signal S2 are set to a high level. At this time, the second thin film transistor T2, the third thin film transistor T3, and the fourth thin film transistor T4 are turned off, and the fifth thin film transistor T5 and the sixth thin film transistor T6 are turned on. At this time, the power supply positive voltage OVDD received from the source of the fifth thin film transistor T5 is output to the point s through the drain of the fifth thin film transistor T5, the potential at the point s becomes Vs=OVDD; and the potential Vg=Vdata−Vth of the point g does not change; the voltage difference between the point s and the point g at this time is Vsg=Vs−Vg=OVDD−(Vdata−Vth)=OVDD−Vdata+Vth. Thus, the driving current supplied to the organic light emitting diode OLED by the first thin film transistor T1 is:

$I_{OLED}=k(V_{sg}-Vth)^2=k(OVDD-Vdata)^2$ where k is the intrinsic conductivity of the first thin film transistor T1. That is, the drive light emission voltage of the first thin film transistor T1 supplied to the organic light emitting diode OLED is OVDD−Vdata.

Thus, the driving current of the organic light emitting diode OLED will be independent of the threshold voltage Vth of the first thin film transistor T1, so that the problem that the threshold voltage drift of the first thin film transistor T1 causes the display of the AMOLED screen to be poor is eliminated.

While the present disclosure has been shown and described with reference to specific embodiments, those skilled in the art will appreciate that various modifications and changes may be made without departing from the spirit and scope of the disclosure as defined by the appended claims and their equivalents, various changes in form and detail may be made therein.

What is claimed is:

1. A light emitting drive circuit, comprising: a reset memory module, a driving module, and a light emitting module;

the reset memory module is used for resetting the driving module according to a first control signal and a second control signal in a potential resetting stage, and for generating and storing a threshold offset voltage corresponding to the driving module in accordance with the first control signal and a data voltage in a threshold offset voltage storage stage;

the driving module is used for generating a light emission drive voltage in a light emission phase in accordance with a power supply positive voltage, a stored threshold compensation voltage, and a light emission control signal;

the light emitting module is configured to emit light in accordance with the light emission drive voltage, the light emission control signal, and a power supply negative voltage in the light emission phase, and the light emission driving voltage is a difference between the power supply positive voltage and the data voltage, wherein, the reset memory module comprises: a second thin film transistor, a third thin film transistor, a fourth thin film transistor and a capacitor, the gate of the second thin film transistor and the third thin film transistor serves as the first control terminal for receiving the first control signal; the gate of the fourth thin film transistor serves as the second control terminal for receiving the second control signal; the source of the second thin film transistor serves as the reset voltage terminal for receiving the reset voltage and the data voltage; the drains of the second thin film transistor are respectively connected to the source of the fourth thin film transistor and the driving module; the drains of the third thin film transistor are respectively connected to the driving module and the light emitting module, the sources of the third thin film transistor are respectively connected to the drains of the fourth thin film transistor and the driving module; one end of the capacitor is connected to the source of the third thin film transistor, the other end of the capacitor is electrically grounded.

2. The light emitting drive circuit according to claim 1, wherein, the reset memory module comprises a first control terminal, a second control terminal and a reset voltage terminal, the first control terminal and the second control terminal are respectively used for receiving a first control signal and a second control signal, and the reset voltage terminal is used for receiving a reset voltage or a data voltage;

the driving module comprises a first drive control terminal, a second drive control terminal, a power supply positive terminal and a first connecting terminal, the first drive control terminal is connected with the reset memory module, the second drive control terminal is adapted to receive the light emission control signal, the power supply positive terminal is used for receiving the power supply positive voltage, the first connection terminal is respectively connected with the reset memory module and the light emitting module;

the light emitting module comprises: a light emitting control terminal, a power supply negative connecting terminal and a second connecting terminal, the light emitting control terminal is used for receiving the light emission control signal, the power supply negative connecting terminal is used for receiving the power supply negative voltage, the second connecting terminal is respectively connected with the reset memory module and the driving module.

3. The light emitting drive circuit according to claim 2, wherein, the first control terminal and the second control terminal respectively receive the first control signal and the second control signal during the potential resetting phase, the reset voltage terminal receives the reset voltage, and the reset memory module transfers the reset voltage to the driving module according to the first control signal and the second control signal;

in the threshold compensation voltage storage stage, the first control terminal receives a first control signal, the reset voltage terminal receives a data voltage, and the reset memory module generates and stores a threshold compensation voltage corresponding to the driving module according to the first control signal and the data voltage.

4. The light emitting drive circuit according to claim 3, wherein, in the light emitting phase, the first drive control terminal receives the stored threshold compensation voltage, the second drive control terminal receives the light emission control signal, the power supply positive terminal receives the power supply positive voltage, the driving module generates a light emission driving voltage based on the power supply positive voltage, the stored threshold compensation voltage, and the light emission control signal.

5. The light emitting drive module according to claim 4, wherein, in the light emitting phase, the light emission control terminal receives the light emission control signal, the power supply negative terminal receives the power supply negative voltage, and the second connection terminal receives the light emission driving voltage.

6. The light emitting drive circuit according to claim 1, wherein, the driving module comprises: a first thin film transistor and a fifth thin film transistor; the gate of the first thin film transistor serves as the first driving control terminal for connecting the source of the third thin film transistor; the sources of the first thin film transistor are respectively connected to the drain of the second thin film transistor and the fifth transistor; the drain of the first thin film transistor serves as the first connecting terminal for connecting to the drain of the third transistor and the light emitting module; the gate of the fifth transistor serves as the second drive control terminal for receiving the light emitting control signal; the source of the fifth transistor serves as the power supply positive connecting terminal for receiving the power supply positive voltage.

7. The light emitting drive circuit according to claim 2, wherein, the driving module comprises: a first thin film transistor and a fifth thin film transistor; the gate of the first thin film transistor serves as the first driving control terminal for connecting the source of the third thin film transistor; the sources of the first thin film transistor are respectively connected to the drain of the second thin film transistor and the fifth transistor; the drain of the first thin film transistor serves as the first connecting terminal for connecting to the drain of the third transistor and the light emitting module; the gate of the fifth transistor serves as the second drive control terminal for receiving the light emitting control signal; the source of the fifth transistor serves as the power supply positive connecting terminal for receiving the power supply positive voltage.

8. The light emitting drive circuit according to claim 6, wherein, the light emitting module comprises: a sixth thin film transistor and an organic light emitting diodes; the gate of the sixth thin film transistor serves as the light emitting control terminal for receiving the light emitting control signal; the source of the sixth thin film transistor serves as the second connecting terminal for connecting to the drain of the first thin film transistor; the drain of the sixth thin film transistor connects to the anode of the organic light emitting diodes; the cathode of the organic light emitting diodes serves as the power supply negative connecting terminal for receiving the power supply negative voltage.

9. The light emitting drive circuit according to claim 7, wherein, the light emitting module comprises: a sixth thin film transistor and an organic light emitting diodes; the gate of the sixth thin film transistor serves as the light emitting control terminal for receiving the light emitting control signal; the source of the sixth thin film transistor serves as the second connecting terminal for connecting to the drain of the first thin film transistor; the drain of the sixth thin film transistor connects to the anode of the organic light emitting diodes; the cathode of the organic light emitting diodes serves as the power supply negative connecting terminal for receiving the power supply negative voltage.

10. The light emitting drive circuit according to claim 6, wherein, the first thin film transistor to the sixth thin film transistor are both P-type thin film transistors, the first control signal, the second control signal and the light emitting control signal are low level signals.

11. The light emitting drive circuit according to claim 7, wherein, the first thin film transistor to the sixth thin film transistor are both P-type thin film transistors, the first control signal, the second control signal and the light emitting control signal are low level signals.

12. An organic light emitting display, wherein, comprising a light emitting drive circuit according to claim 1.

* * * * *